US009462862B2

(12) United States Patent
Condon et al.

(10) Patent No.: US 9,462,862 B2
(45) Date of Patent: Oct. 11, 2016

(54) REUSABLE SHOPPING BAG STORAGE AND DISPENSING SYSTEM

(71) Applicants: Donna Condon, Watsonville, CA (US); Anthony Christopher Condon, Watsonville, CA (US)

(72) Inventors: Donna Condon, Watsonville, CA (US); Anthony Christopher Condon, Watsonville, CA (US)

( * ) Notice: Subject to any disclaimer, the term of this patent is extended or adjusted under 35 U.S.C. 154(b) by 2 days.

(21) Appl. No.: 14/196,663

(22) Filed: Mar. 4, 2014

(65) Prior Publication Data

US 2014/0246449 A1 Sep. 4, 2014

Related U.S. Application Data

(60) Provisional application No. 61/772,123, filed on Mar. 4, 2013.

(51) Int. Cl.

| | |
|---|---|
| ***B65H 1/00*** | (2006.01) |
| ***A45C 3/04*** | (2006.01) |
| ***A45C 13/10*** | (2006.01) |
| ***A45C 15/00*** | (2006.01) |
| *A45C 13/02* | (2006.01) |

(52) U.S. Cl.

CPC ..... *A45C 3/04* (2013.01); *A45C 13/1046* (2013.01); *A45C 15/00* (2013.01); *A45C 13/02* (2013.01)

(58) Field of Classification Search

CPC ..... A45C 13/001; A45C 1/02; A45C 3/06; B65D 83/0805

USPC ..... 221/1, 33; 150/106; 383/107

See application file for complete search history.

(56) References Cited

U.S. PATENT DOCUMENTS

| | | | | |
|---|---|---|---|---|
| 2,038,952 | A * | 4/1936 | Niedorff | A45C 3/04 224/218 |
| 3,142,435 | A * | 7/1964 | Stange | B65D 33/12 206/554 |
| 3,690,221 | A * | 9/1972 | Schmedding | B65D 31/08 383/10 |
| 4,988,216 | A * | 1/1991 | Lyman | 383/74 |
| 5,046,860 | A | 9/1991 | Brennan | |
| 5,182,895 | A | 2/1993 | Lugo | |
| 5,209,385 | A | 5/1993 | Ledesma | |
| 5,451,108 | A * | 9/1995 | Anderson | B65D 31/12 383/38 |
| 6,085,695 | A * | 7/2000 | Miller | A01K 27/006 119/795 |
| D571,102 | S * | 6/2008 | Gostt | D3/244 |
| 8,342,750 | B2 | 1/2013 | Heinlen et al. | |
| 2005/0028910 | A1* | 2/2005 | Duty | A45C 3/04 150/128 |
| 2010/0008604 | A1* | 1/2010 | McIver | B65D 31/02 383/107 |
| 2011/0314608 | A1* | 12/2011 | Rovin | 5/655 |
| 2012/0241463 | A1* | 9/2012 | Zimmerman | B65D 5/542 221/1 |
| 2012/0243806 | A1 | 9/2012 | Parks | |

* cited by examiner

*Primary Examiner* — Rakesh Kumar

(74) *Attorney, Agent, or Firm* — Donald R. Boys; Central Coast Patent Agency, Inc.

(57) ABSTRACT

A shopping bag dispenser has a fabric storage and dispensing bag with an open end having an area of opening, and a length, and a plurality of shopping bags having common dimensions, each formed from a material having a low coefficient of friction, and capable of sustaining permanent fold creases. Each shopping bag of the plurality is implemented with permanent fold creases, folded along the creases and stacked with others of the plurality, to a folded and stacked size having a length less than the length of the storage bag and a cross-sectional area orthogonal to the length less than the area of the opening of the fabric storage and dispensing bag.

10 Claims, 11 Drawing Sheets

REUSABLE SHOPPING BAG STORAGE AND DISPENSING SYSTEM

CROSS-REFERENCE TO RELATED DOCUMENTS

The system is a non-provisional application of U.S. provisional application Ser. No. 61/772,123, filed Mar. 4, 2013, entitled "Reusable Shopping Bag Storage and Dispensing System", the entire disclosure of which is incorporated herein in its entirety at least by reference.

BACKGROUND OF THE INVENTION

1. Field of the Invention

The present invention is in the field of articles for storage or transport of other articles, and pertains more particularly to reusable shopping bags.

2. Description of Related Art

It is well known that many municipalities have enacted ordinances to limit or eliminate the use of plastic and or paper bags, and also to authorize grocery stores and other enterprises to charge for paper bags. These new ordinances bring about distaste and inconvenience in the shopping experience. Not only do shoppers have to pay expensive prices for groceries, they also have to pay up to twenty five cents per bag. As a result it has become desirable for shoppers to bring their own bags, such as reusable cloth bags, when visiting a retail establishment that may charge for bags to carry purchased items away. Therefore what is clearly needed in the art is storage and dispensing enclosure system that may be used to hold a plurality of shopping bags in a manner that bags may be individually withdrawn and used to hold a plurality of purchased items and then reinserted with a high degree of organization in a small footprint resulting in a unique form factor.

BRIEF SUMMARY OF THE INVENTION

In one embodiment of the invention a shopping bag dispenser is provided, comprising a fabric storage and dispensing bag with an open end having an area of opening, and a length, and a plurality of shopping bags having common dimensions, each formed from a material having a low coefficient of friction, and capable of sustaining permanent fold creases. Each shopping bag of the plurality is implemented with permanent fold creases, folded along the creases and stacked with others of the plurality, to a folded and stacked size having a length less than the length of the storage bag and a cross-sectional area orthogonal to the length less than the area of the opening of the fabric storage and dispensing bag.

In one embodiment the storage and dispensing bag comprises a drawstring implemented in a channel at the open end, such that the storage and dispensing bag may be closed or opened by manipulating the drawstring. Also in one embodiment the drawstring comprises a spring-loaded gripping element enabling holding the open end closed with the drawstring drawn. Also in one embodiment the storage and dispensing bag is implemented with a closure along one side for a portion of the length, allowing the storage and dispensing bag to be opened to facilitate loading with a stack of folded shopping bags. In one embodiment the closure is a zipper.

In one embodiment the shopping bag dispenser further comprises a wrapper implemented as a fabric panel having a width and a length, attachable at one end of the length to an inner surface of the storage and dispensing bag with the width of the wrapper in line with the length of the storage and dispensing bag, such that a stack of shopping bags may be wrapped in the wrapper within the storage and dispensing bag prior to closing the closure. Also in one embodiment the wrapper is implemented with fastening elements providing fastening the wrapper around the stack of shopping bags once the stack of shopping bags is wrapped. Still in one embodiment the shopping bag dispenser further comprises a carabineer attached to the gripping element or to the storage and dispensing bag, facilitating clipping the shopping bag dispenser to an article of clothing or to a shopping cart or carriage.

In another aspect of the invention a method of dispensing shopping bags is provided, comprising steps (a) implementing a plurality of shopping bags from fabric having a low coefficient of friction, with a pattern of permanent creases; (b) folding each of the plurality of shopping bags along the permanent creases and stacking the plurality together into a stack having a length and a cross-sectional area orthogonal to the length; and (c) inserting the stack of shopping bags into a fabric storage and dispensing bag with an open end having an area of opening greater than the cross-sectional area of the stack of shopping bags, and a length greater than the length of the stack, providing a dispenser enabling one shopping bag at a time to be drawn from the storage and dispensing bag at need.

In one embodiment of the method the storage and dispensing bag comprises a drawstring implemented in a channel at the open end, such that the storage and dispensing bag may be closed or opened by manipulating the drawstring. Also in one embodiment the drawstring comprises a spring-loaded gripping element enabling holding the open end closed with the drawstring drawn. Also in one embodiment the storage and dispensing bag is implemented with a closure along one side for a portion of the length, allowing the storage and dispensing bag to be opened to facilitate loading with a stack of folded shopping bags. In one embodiment the closure is a zipper.

In one embodiment the method further comprises a wrapper implemented as a fabric panel having a width and a length, attachable at one end of the length to an inner surface of the storage and dispensing bag with the width of the wrapper in line with the length of the storage and dispensing bag, such that a stack of shopping bags may be wrapped in the wrapper within the storage and dispensing bag prior to closing the closure. Also in one embodiment the wrapper is implemented with fastening elements providing fastening the wrapper around the stack of shopping bags once the stack of shopping bags is wrapped. Also in one embodiment there is a carabineer attached to the gripping element or to the storage and dispensing bag, facilitating clipping the shopping bag dispenser to an article of clothing or to a shopping cart or carriage.

BRIEF DESCRIPTION OF THE SEVERAL VIEWS OF THE DRAWINGS

FIG. 2(*b*) is an illustration of a stack of folded shopping bags in an embodiment of the present invention.

DETAILED DESCRIPTION OF THE INVENTION

Figure 1:
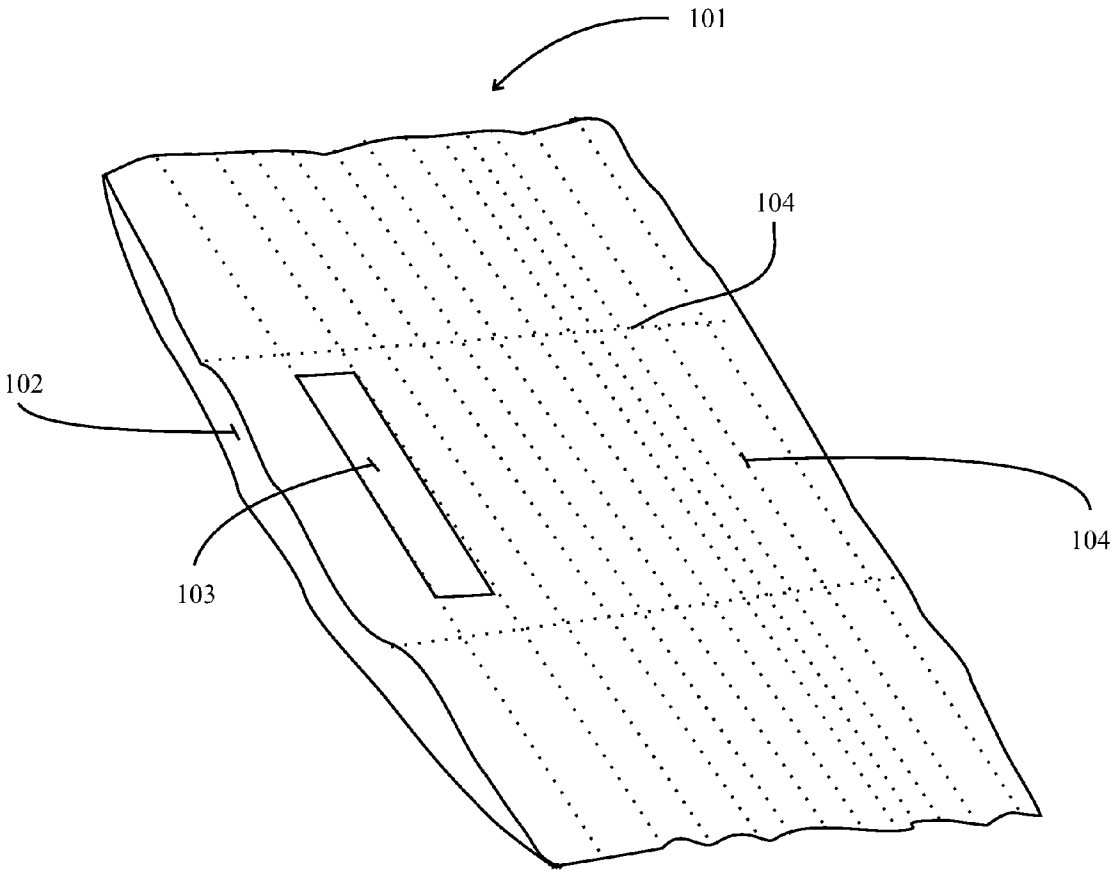
FIG. 1 is an illustration of a shopping bag exemplary of the type of bag suitable for shopping bags in an embodiment of the present invention.

FIG. 1 is an illustration of a shopping bag exemplary of the type of bag suitable for shopping bags in an embodiment of the present invention. Shopping bag 101 is made from a material with a low coefficient of friction to other materials. In one embodiment the material is silk. In another embodiment the material is ripstop nylon. In one embodiment shopping bag 101 is made of silnylon which is a form of ripstop nylon incorporating silicone. Ripstop fabrics are woven fabrics, often made of nylon, using a special reinforcing technique that makes them resistant to tearing and ripping. During weaving, reinforcement threads are interwoven at regular intervals in a crosshatch pattern. The intervals are typically 5 to 8 millimeters (0.2 to 0.3 in). Thin and lightweight ripstop fabrics have a 3-dimensional structure due to the thicker threads being interwoven in thinner cloth. Older lightweight ripstop fabrics display the thicker interlocking thread patterns in the material quite prominently, but more modern weaving techniques make the ripstop threads less obvious.

Another characteristic of bag 101 is that when the material is folded, permanent fold creases 104 may be formed which enhance the ability of the bag to be accurately folded and re-folded along these creases. Once folded the material maintains the creases very well and facilitates refolding once the shopping bag is emptied. This folding memory enhances the ability of the user to refold the bag into its preferred shape for reinsertion info a container.

In FIG. 1 a handle 103 may be incorporated. Handle 103 is used to facilitate carrying bag 101. Handle 103 may be made of various materials therefore the type of material is not intended to be a limitation rather any material can be used for handle 103 and bag 101. Element 102 indicates a single opening into the shopping bag.

Figure 2A:
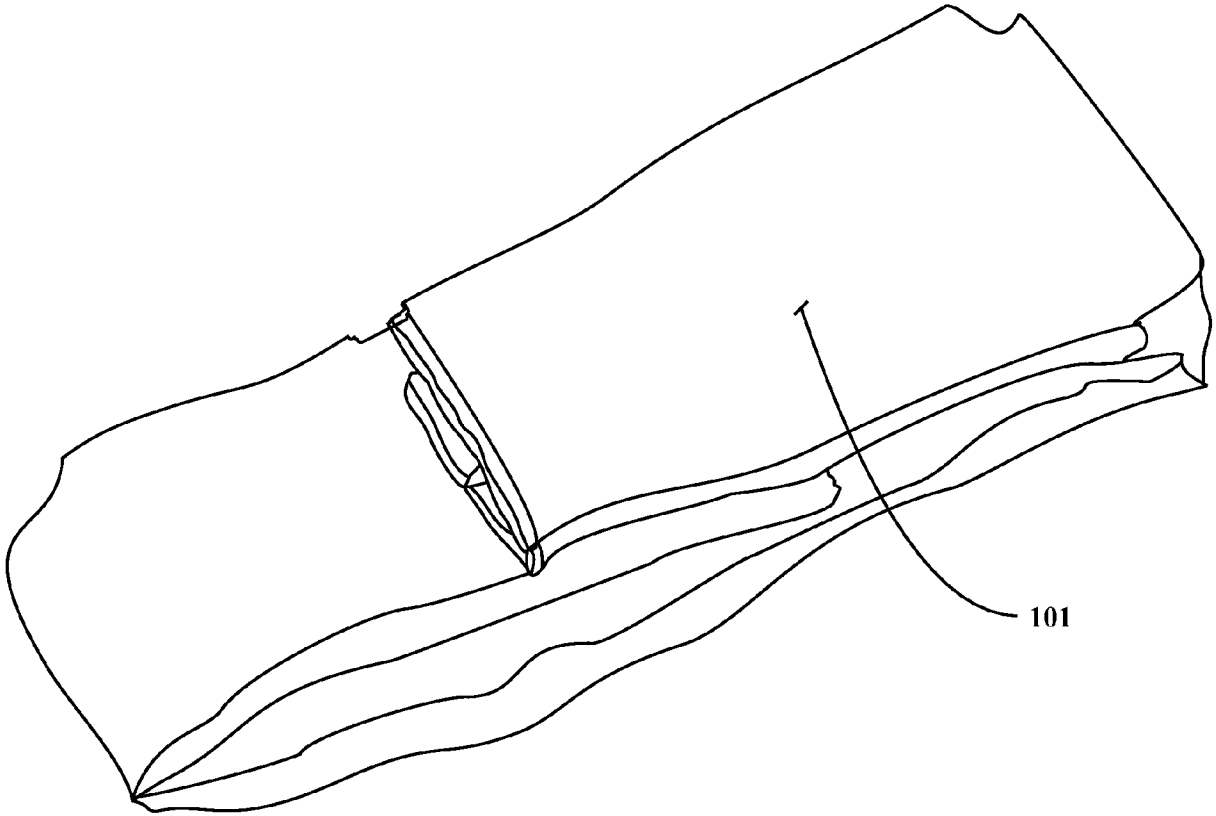
FIG. 2(*a*) is an illustration of a folded shopping bag exemplary of the type of bag suitable for shopping bags in an embodiment of the present invention.
Figure 2B:
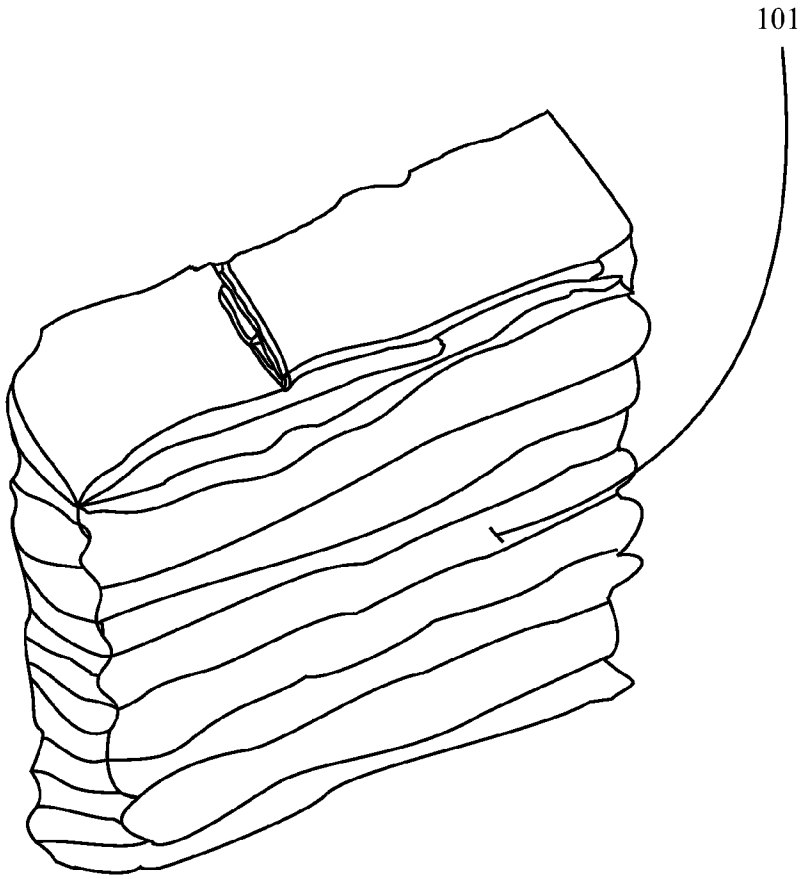

FIG. 2(*a*) illustrates shopping bag 101 folded along folding lines 104 (shown in FIG. 1) which may produce a compact folded bag. Several bags 101 may be stacked together in practicing the present invention as illustrated in FIG. 2(*b*).

Figure 3:
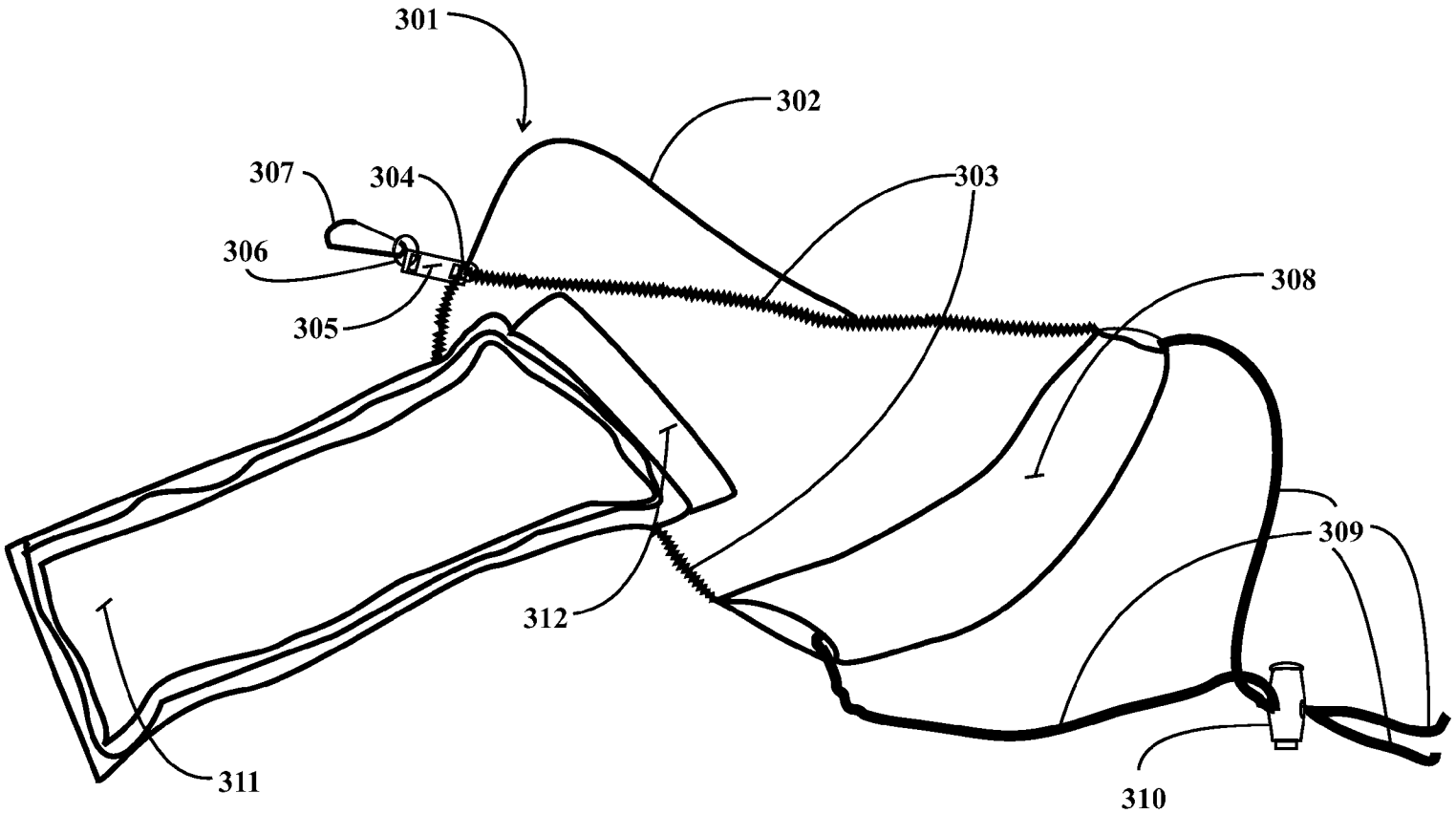
FIG. 3 Illustrates a shopping bag container opened to receive folded bags according to one embodiment of the present invention.

FIG. 3 illustrates a storage bag 301 opened fully, prior to wrapping and storing shopping bags 101. Storage bag 301 has an outer skin 302 which may form a cylindrical tube when a zipper 303 is drawn closed. Drawing zipper 303 closed may be achieved by a user grasping a pull tab 305 and dragging an attached zipper slider 304 along to mesh the zipper's teeth to seal most of the length of the storage bag 301. In some embodiments closure of storage bag 301 may accomplished via buttons, Velcro™, or by some other means. Outer skin 302 may also be made from a variety of pliable materials such as natural or artificial fiber, cloth, plastic, hessian or metal chain mesh, for example, depending at least in part upon strength required, weight consideration, availability or fabrication cost factors. Fabric of outer skin 302 may also be intrinsically waterproof or treated with a waterproofing agent.

In one embodiment there is a carabineer 307 connected to pull tab 305 via a split ring 306. One purpose of attaching carabineer 307 to the present invention may be to enable storage bag 301 to be attached to another object such as, for example, a shopping cart. This may allow a user to carry storage bag 301 without the use of hands. One purpose of using split ring 306 may be to ensure that carabineer 307 is not easily detached from pull tab 305.

In one embodiment outer skin 302 may not be fully enclosed by zipper 303 along the total length of storage bag 301. This allows a non-zippered portion of outer skin 302 to retain an open flange section 308 when zipper 303 is fully drawn in the closed position. In one embodiment providing open flange section 308 may assist in dispensing the stacked bags shown in FIG. 2(*b*). In another embodiment storage bag 301 may also incorporate drawstring 309 which may loop through the ends of each side of outer skin 302. Drawstring 309 may then be drawn tight to constrain the stacked bags shown in FIG. 2(*b*). Drawstring 309 may have a locking mechanism such as a spring-loaded drawstring gripping element 310. In one embodiment drawstring gripping element 310 may be used to keep drawstring 309 in the fully drawn position or any other convenient position.

FIG. 3 further illustrates a constraining element 311 which may be used to surround and constrain folded and stacked shopping bags (shown as element 101 in FIG. 2*b*) and hold them together inside storage bag 301. Constraining element 311 is further discussed below with reference to FIG. 4.

Figure 4:
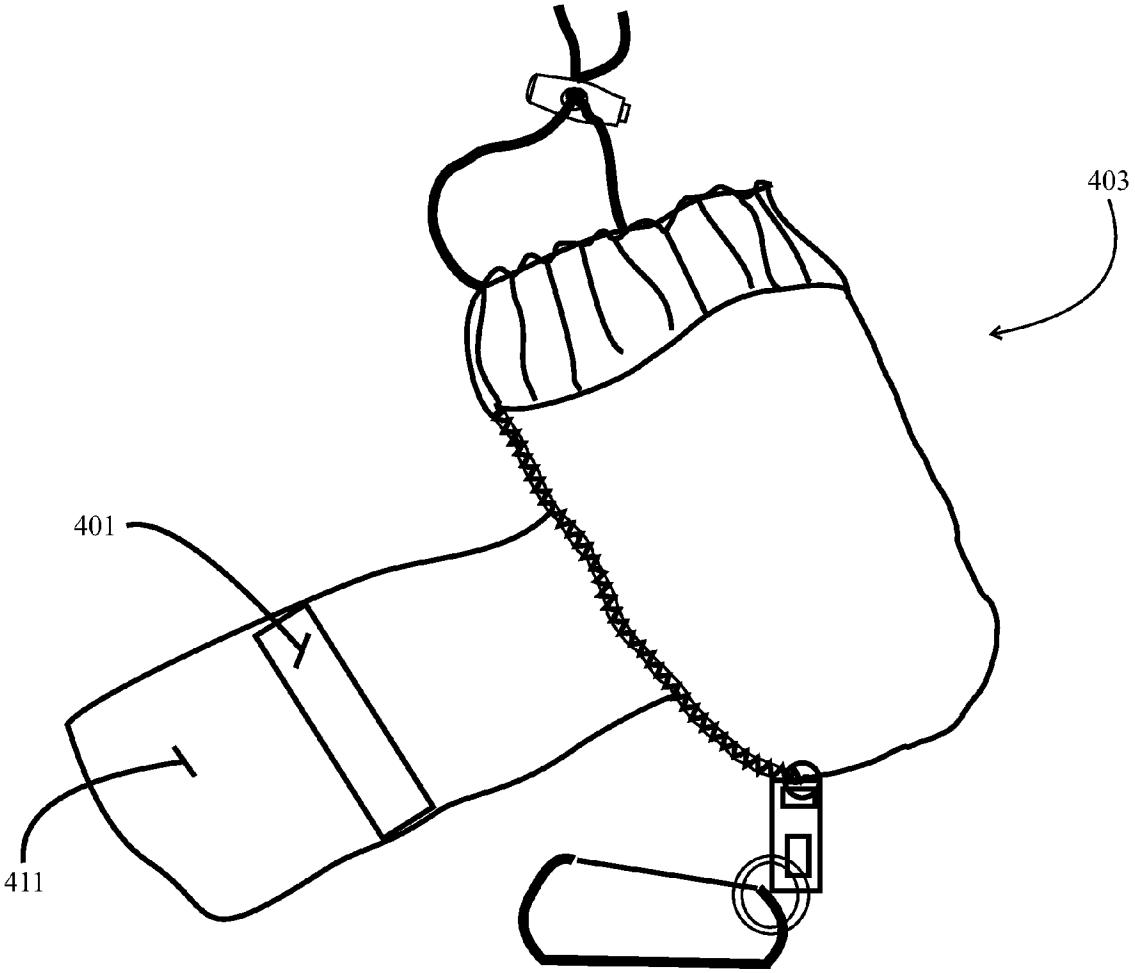
FIG. 4 illustrates a storage bag container according to one embodiment of the present invention.

FIG. 4 illustrates a storage bag container according to one embodiment of the present invention. Constraining element 411, equivalent to element 311 of FIG. 3, may incorporate a Velcro strip 401 attached to the exterior of constraining element 411. Velcro strip 401 is adapted to join with an internal Velcro securing strip (shown as element 312 of FIG. 3) to constrain and secure a plurality of pre-folded and stacked shopping bags inside storage bag 403. Constraining element 411 may be attached to the inside of storage bag 401 by various means. In one embodiment element 411 is sewn to the inside of storage bag 403. In other embodiments it is attached via a plurality of buttons, fasteners, of by any other convenient means.

In other embodiments constraining element 411 may be a separate element such that a user may wrap folded bags separately. In this circumstance a user might have two or more stacks of folded bags, so when one set is dispensed completely, it is only necessary to place another pre-prepared set of folded bags into the storage bag 403.

Figure 5:
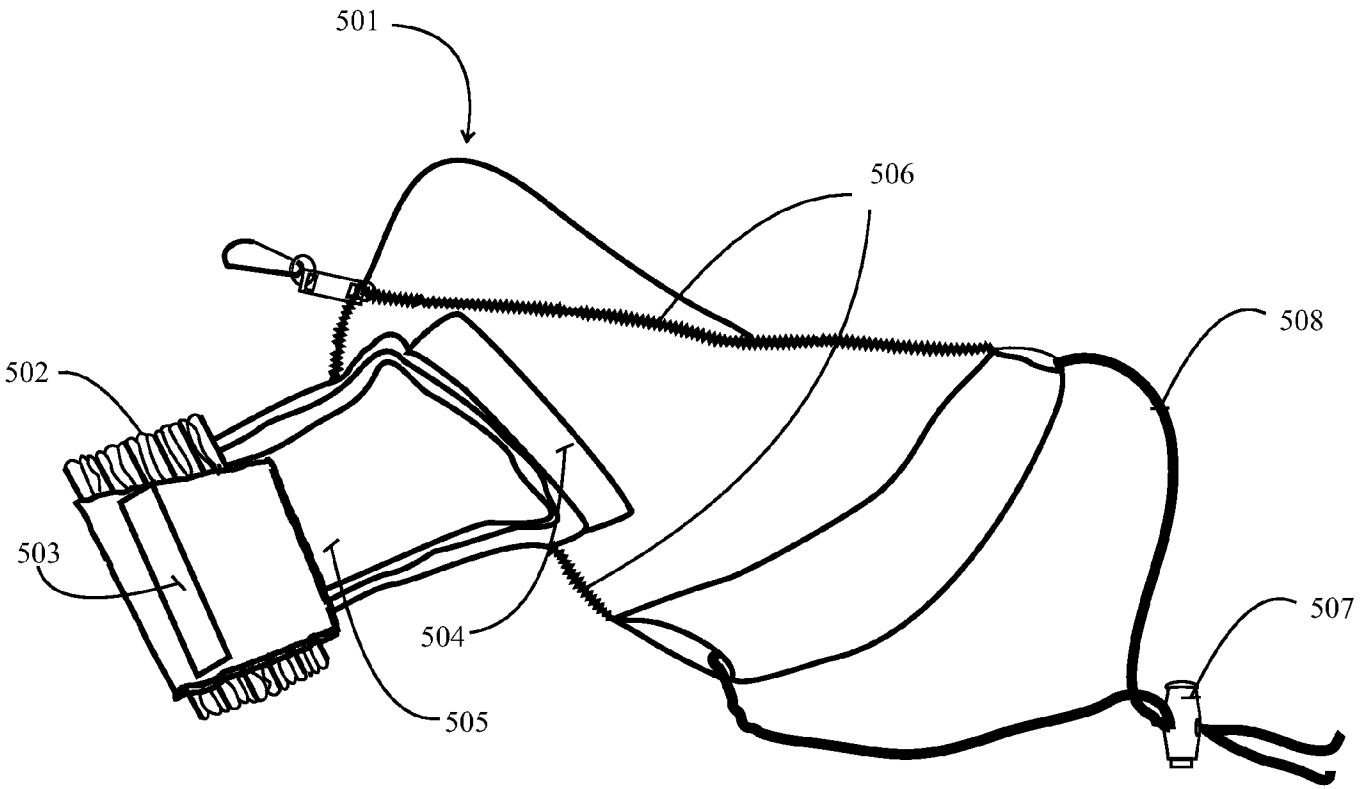
FIG. 5 illustrates a shopping bag container holding shopping bags according to one embodiment of the invention.

FIG. 5 illustrates a shopping bag container holding shopping bags according to one embodiment of the invention. In this embodiment a stack of pre-folded shopping bags 502 are wrapped with constraining element 505. Constraining element 505 surrounds a plurality of pre-folded shopping bags 502 such that continued rolling or folding of constraining element 505 will cause Velcro strip 503 to adhere to Velcro pad 504 thereby constraining the pre-folded shopping bags to the interior of storage bag 501. Once the pluralities of bags are constrained to the interior of storage bag 501 the storage bag may be zipped up via zipper 506. Once storage bag 501 is zipped up, spring-loaded drawstring gripping element 507 is grasped and drawstring 508 is pulled therethrough causing storage bag 501 to close around the plurality of previously constrained bags 502. It is known to the inventor that other methods of constraining shopping bags 502 in storage bag 501 may be used therefore the method of constraint of FIG. 5 is exemplary in nature and not intended to be limiting. For example, a hook and eye linking mechanism may be appropriate for this purpose and therefore other securing mechanisms could be used.

Figure 6:
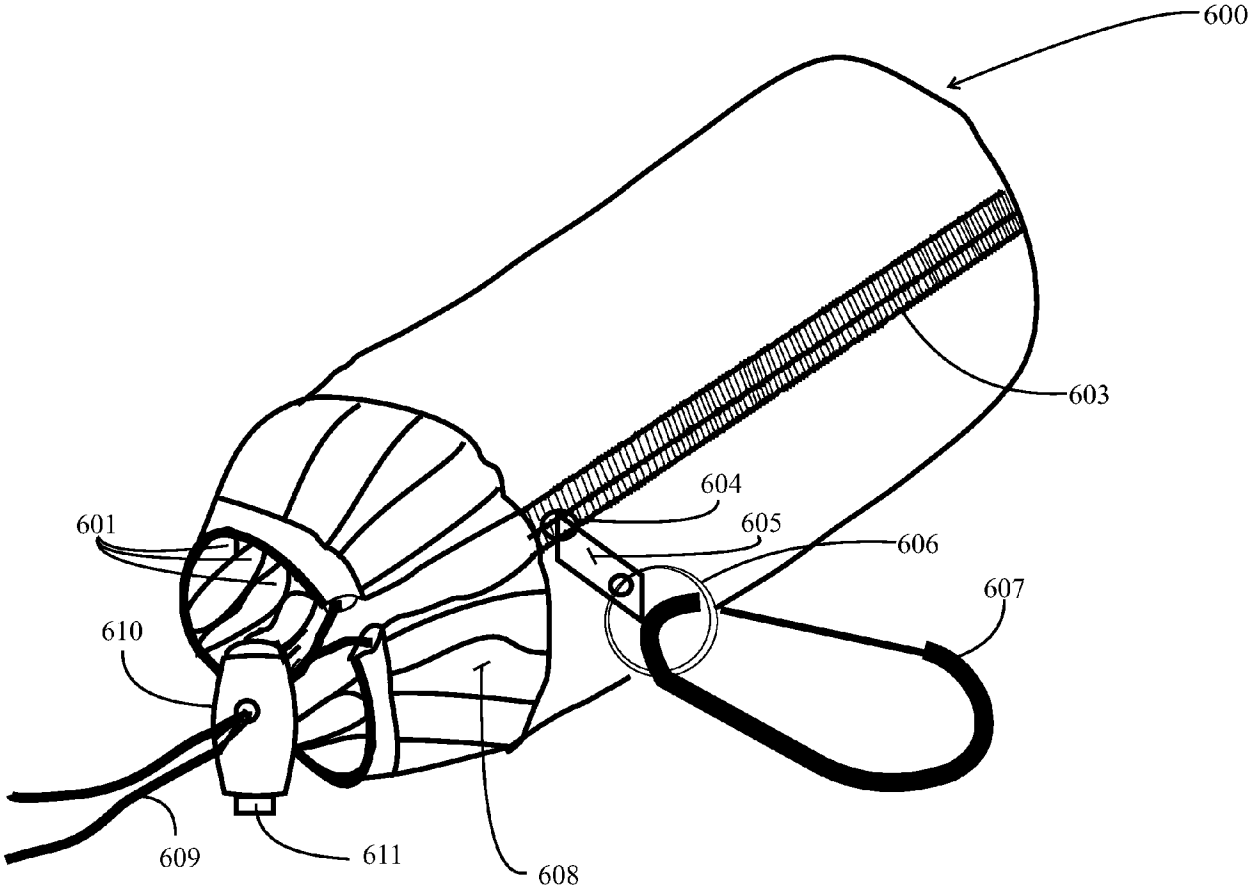
FIG. 6 illustrates a closed shopping bag container enclosing a plurality of folded shopping bags according to one embodiment of the present invention.

FIG. 6 is an illustration of a storage bag 600 containing a plurality of shopping bags 601, the storage bag containing the shopping bags in the closed position. Flange opening 608 may assist in dispensing stacked bags 601 by widening the storage bag opening. A user may open storage bag 600 to this position by loosening spring-loaded drawstring gripping element 610 by pressing spring loaded button 611 and loosening drawstring 609 sufficiently to expose the ends of stacked shopping bags 601, which may allow a user to extract one bag at a time to, for example, hand over each bag to a cashier to pack purchased items. Zipper elements 603, 604, 605, 606 do not have to be used in the store as the shopping bags may be accessed by the method discussed above thereby providing a convenience not previously afforded shoppers. In this closed position the shopping bag storage system has a small profile such that the whole unit may be carried in a purse or snapped via carabineer 607 to a belt loop, shopping cart or other such convenient place.

Figure 7:
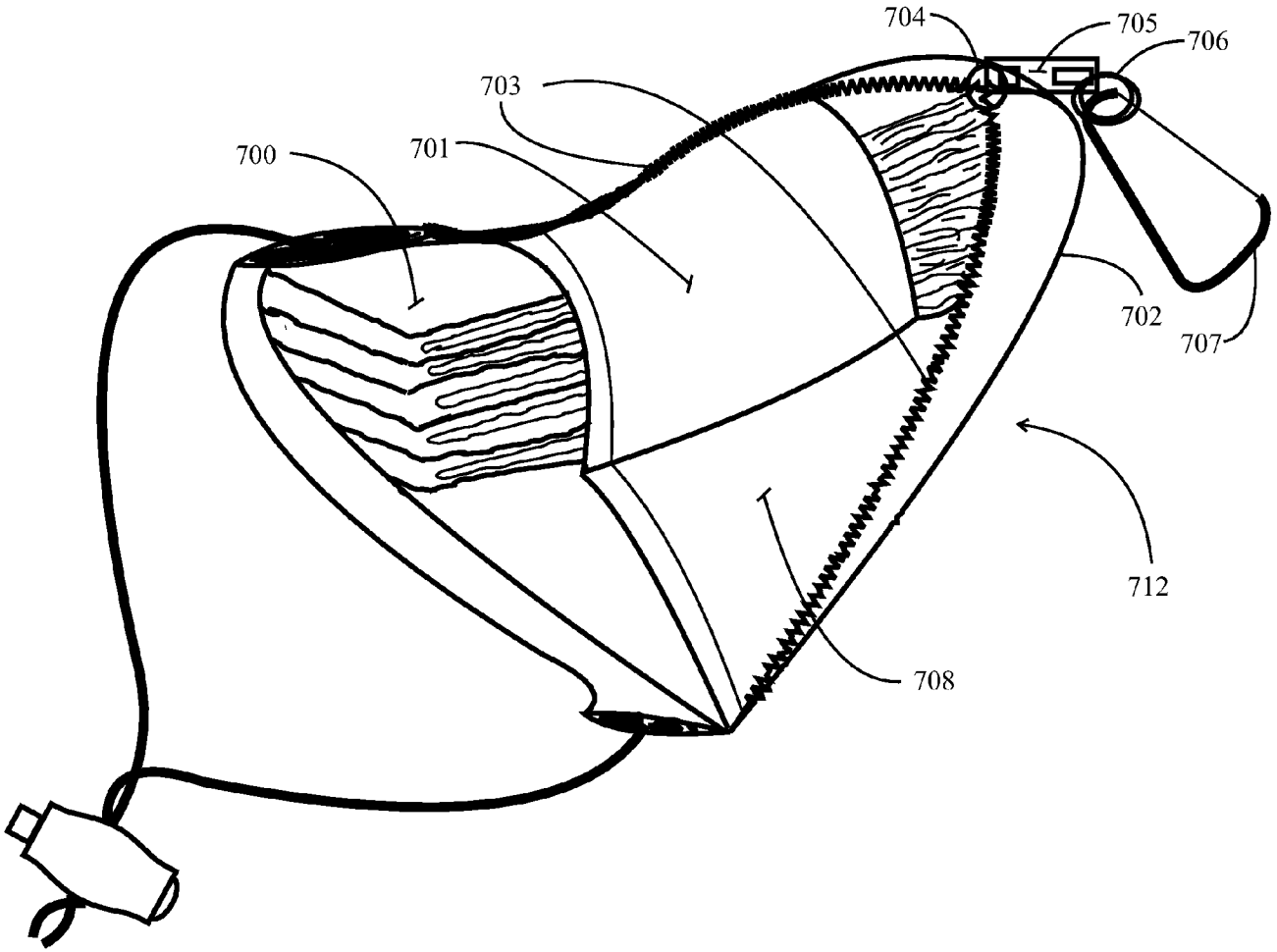
FIG. 7 illustrates an open shopping bag container illustrating an internal bag enclosing member according to one embodiment of the present invention.

FIG. 7 illustrates an open shopping bag container system 712 illustrating an internal bag constraining member 701 according to one embodiment of the present invention. In this view a plurality of pre-folded shopping bags 700 are shown wrapped and secured via Velcro (discussed earlier) within constraining element 701. Constraining element 701 is firmly attached via sewing or glue, or any other method, to contiguous material 708. Material 708 is attached to the interior of storage bag 702. The attachment of a fairly large portion of material 708 to the inside of storage bag 702 insures a very strong marriage of the materials.

When a user is done shopping and has emptied all of the shopping bags of groceries or other items, the user may re-fold the bags 700 and wrap them in constraining element 701 such that they are attached to the interior of storage bag 702 once again. Once this is done the user will zip up bag 702 via zipper 703. Zipper 703 is attached to bag 702 by a number of standard means which may include sewing, gluing etc. A zipper sliding body (not shown) causes the material of storage bag 702 to come together when urged towards the top of storage bag 702. Zipper sliding body (not shown) is attached to zipper tab 705 via ring 704. Zipper tab 705 is further attached to another ring 706 which facilitates attachment to carabineer 707 to facilitate attachment to shopping cart etc. . . .

Figure 8:
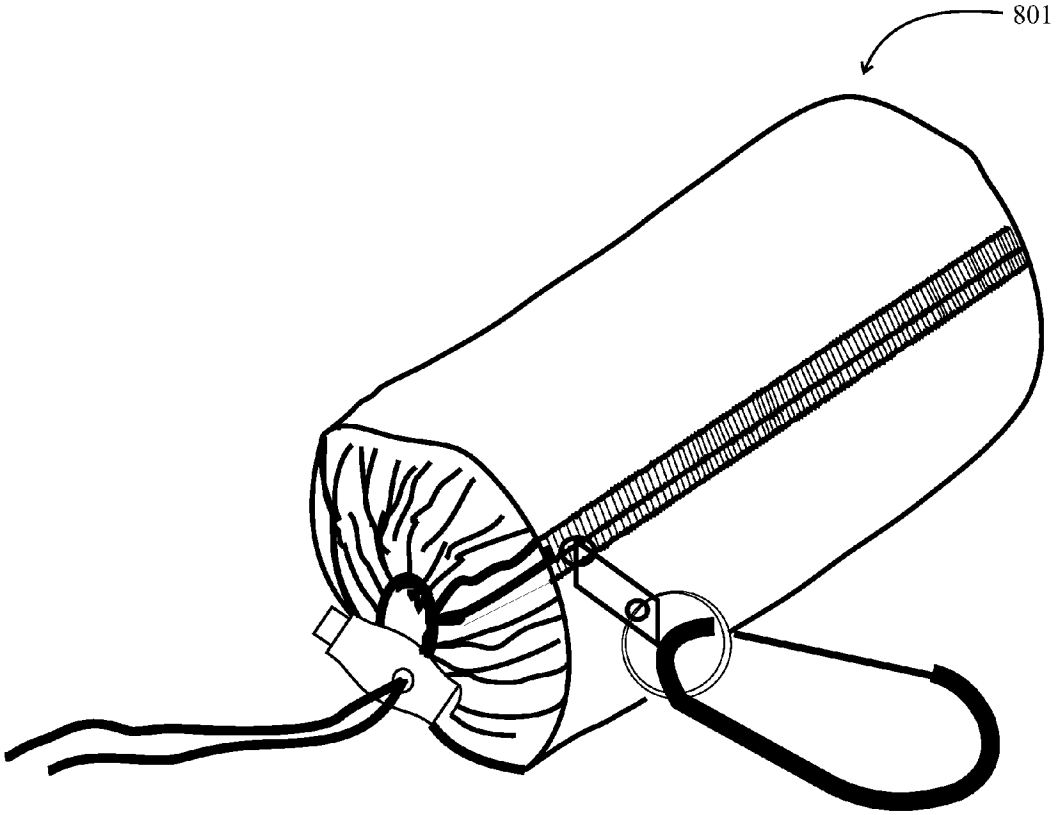
FIG. 8 illustrates a closed shopping bag container system according to one embodiment of the present invention.

FIG. 8 is a perspective view of storage bag system 801 fully zippered and closed. One experienced in the art will recognize the advantage of the compact form factor which can enclose from a few to many shopping bags. The packaged bags can be carried in a pocket of a jacket, in a purse, in the pocket of a pair of jeans or just clipped to a loop of any material that is part of the clothing or clothing accessory, or clipped to a portion of a shopping cart. The packaged bags might be implemented in a wide variety of bag sizes, depending in part upon the many purposes of the invention, and therefore other dimensions could be used which should not be construed as limiting the scope of the invention.

Figure 9:
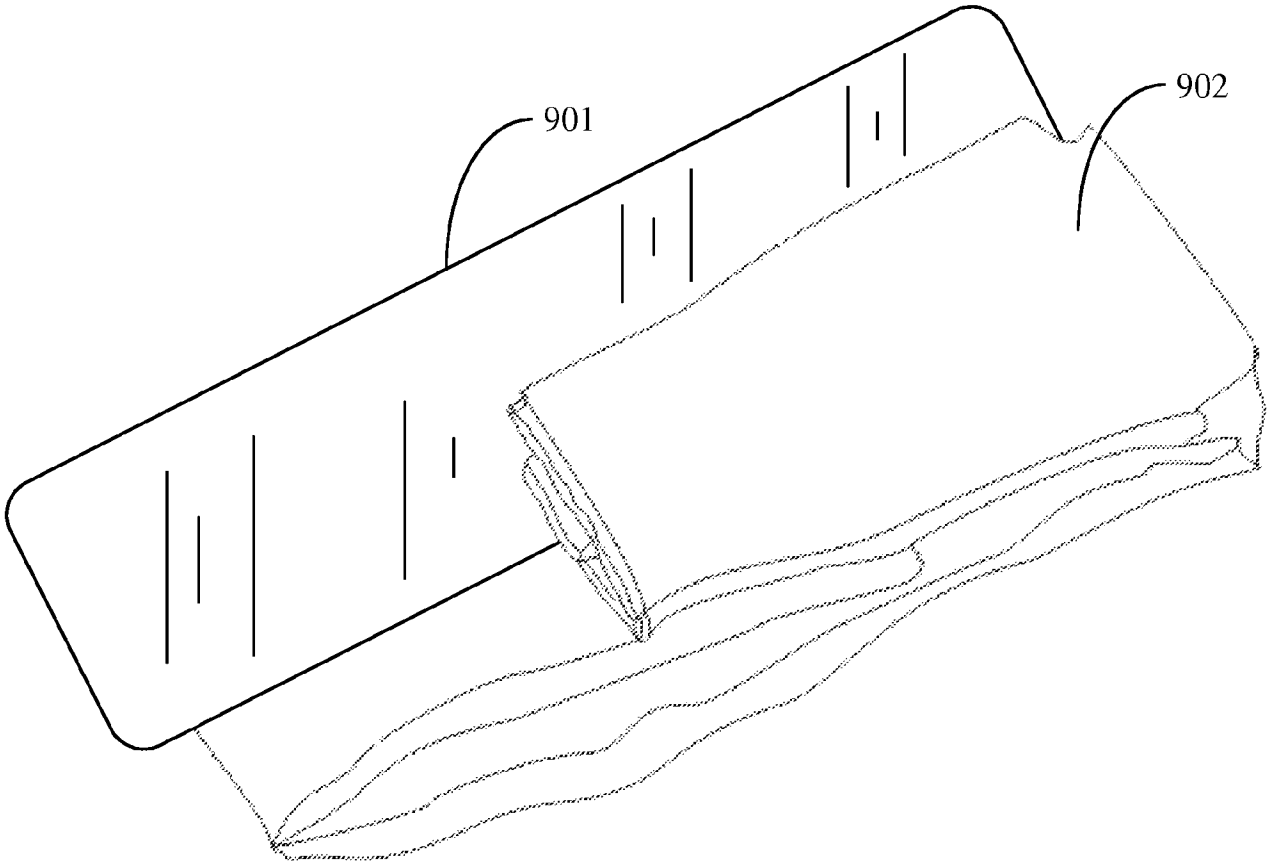
FIG. 9 illustrates a shopping bag folded over an insertion element prior to insertion into shopping bag container according to one embodiment of the present invention.

FIG. 9 is an illustration of a shopping bag insertion method according to an embodiment of the present invention. Element 901 is a bag insertion element. This element is made from a sufficiently thin stiff material. The material may be plastic, wood, polyurethane, polyvinyl chloride plastic, ABS plastic or any other material capable of urging shopping bag 902 into a storage bag. In one embodiment the insertion element 901 is a plastic, solar charged calculator. The shopper may use this to calculate groceries prices and check totals at check out. In one embodiment the insertion element is an internet connected device capable of checking prices of grocery items against other sellers. In another embodiment the insertion element is capable of scanning skews of grocery items and comparing them to other sellers or totaling items at checkout. In another embodiment the insertion device is a computerized appliance. A shopper scans the groceries with said appliance and utilizes a self check out, the self checkout tallying the groceries from the previously scanned groceries.

Figure 10:
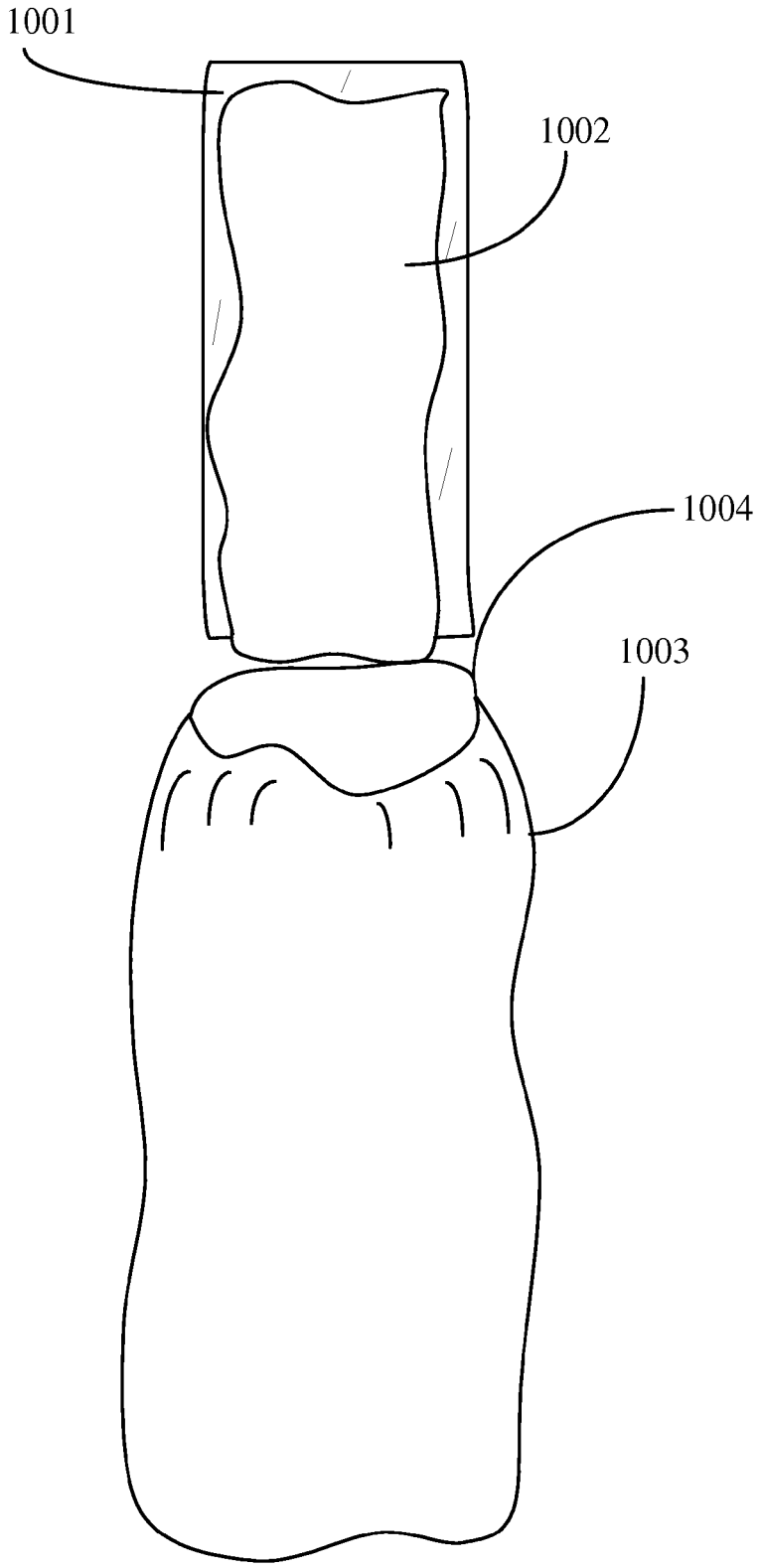
FIG. 10 illustrates a shopping bag folded over an insertion element prior to insertion into shopping bag container according to one embodiment of the present invention.

FIG. 10 is an illustration of an insertion device according to an embodiment of the present invention. In this embodiment storage bag 1003 is made of an elastic material. Pre-folded shopping bag 1002 is folded over insertion device 1001 enabling shopping bags to be inserted into storage bag 1003 very easily. The pre-folded bag 1002 being made of very slippery material as mentioned earlier in this specification. In this embodiment only a one-piece storage bag is necessary with no need for a zipper or a constraining element. In another embodiment the rim of storage bag 1003 is formed into an elastic closure. In practice shopping bag 1002 is folded over plastic insertion element 1001. Because of the stiffness of insertion element the elastic closure 1004 is forced open to receive shopping bag 1002. Once insertion element is removed the elastic storage bag and elastic closure close around previously inserted shopping bag 1002. A plurality of shopping bags may be inserted in this way into storage bag 1003. Once inserted all bags are securely held in storage bag 1003 and may be removed and re-inserted easily.

The invention claimed is:

1. A shopping bag dispenser, comprising:

a fabric storage and dispensing bag with an open end having a width and height of opening, and a length, implemented with a closure along one side for a portion of the length, allowing the fabric storage and dispensing bag to be opened to facilitate loading with a stack of shopping bags;

a plurality of shopping bags having common dimensions, each formed from a material having a low coefficient of friction capable of forming permanent fold creases, each shopping bag formed with two flat panels joined along a bottom and opposite side edges, and open along a top edge, each bag thus exhibiting a height dimension from the bottom edge to the open top edge, and a width dimension across the opposite side edges, at a right angle to the height dimension, each bag having one or more vertical permanent fold creases from bottom to top parallel to the side edges, dividing the side panels into substantially equal portions, such that each bag when folded along the vertical permanent fold creases exhibits a folded dimension less than the length of the fabric storage and dispensing bag, and each bag further having three or more permanent horizontal fold creases from side edge to opposite side edge dividing the bag into substantially equal portions such that each bag when folded along the horizontal permanent fold creases exhibits a folded dimension less than the width of opening of the fabric storage and dispensing bag; and a wrapper implemented as a fabric panel having a width and a length, attachable at one end of the length to an inner surface of the storage and dispensing bag with the width of the wrapper in line with the length of the storage and dispensing bag, such that a stack of shopping bags may be wrapped in the wrapper within the storage and dispensing bag prior to closing, the wrapper having fastening elements providing fastening the wrapper around the stack of shopping bags once the stack of shopping bags is wrapped;

wherein with the plurality of shopping bags each folded along both the horizontal and vertical permanent fold creases, stacked conformally, and placed in the fabric storage and dispensing bag, may be grasped and pulled from the fabric storage and dispensing bag one bag at a time, and opened along the permanent fold creases to be used as a shopping bag.

2. The shopping bag dispenser of claim 1 wherein the storage and dispensing bag comprises a drawstring implemented in a channel at the open end, such that the storage and dispensing bag may be closed or opened by manipulating the drawstring.

3. The shopping bag dispenser of claim 2 wherein the drawstring comprises a spring-loaded gripping element enabling holding the open end closed with the drawstring drawn.

4. The shopping bag dispenser of claim 3 further comprising a carabineer attached to the gripping element or to the storage and dispensing bag, facilitating clipping the shopping bag dispenser to an article of clothing or to a shopping cart or carriage.

5. The shopping bag dispenser of claim 1 wherein the closure is a zipper.

6. A method of dispensing shopping bags, comprising steps:

(a) implementing a plurality of shopping bags from fabric having a low coefficient of friction and capable of forming permanent fold creases, each shopping bag formed with two flat panels joined along a bottom and opposite side edges, and open along a top edge, each bag thus exhibiting a height dimension from the bottom edge to the open top edge, and a width dimension across the opposite side edges, at a right angle to the height dimension, each bag having one or more vertical permanent fold creases from bottom to top parallel to the side edges, dividing the side panels into substantially equal portions, such that each bag when folded along the vertical permanent fold creases exhibits a folded dimension less than the length of the fabric storage and dispensing bag, and each bag further having three or more permanent horizontal fold creases from side edge to opposite side edge dividing the bag into substantially equal portions such that each bag when folded along the horizontal permanent fold creases exhibits a folded dimension less than the width of opening of the fabric storage and dispensing bag;

(b) folding each of the plurality of shopping bags along the permanent fold creases and stacking the plurality conformally into a stack having a length and a cross-sectional area orthogonal to the length; and (c) inserting the stack of shopping bags into a fabric storage and dispensing bag with an open end having a width and height greater than the width and height of one of the folded shopping bags, and a length greater than the length of the stack, implemented with a closure along one side for a portion of the length, allowing the fabric storage and dispensing bag to be opened to facilitate loading with a stack of folded shopping bags, the storage and dispensing bag further comprising a wrapper implemented as a fabric panel having a width and a length, attachable at one end of the length to an inner surface of the storage and dispensing bag with the width of the wrapper in line with the length of the fabric storage and dispensing bag, such that a stack of shopping bags may be wrapped in the wrapper within the fabric storage and dispensing bag prior to closing the closure, the wrapper implemented with fastening elements providing fastening the wrapper around the stack of shopping bags once the stack of shopping bags is wrapped, providing a dispenser enabling one shopping bag at a time to be drawn from the storage and dispensing bag at need.

7. The method of claim 6 wherein the storage and dispensing bag comprises a drawstring implemented in a channel at the open end, such that the storage and dispensing bag may be closed or opened by manipulating the drawstring.

8. The method of claim 7 wherein the drawstring comprises a spring-loaded gripping element enabling holding the open end closed with the drawstring drawn.

9. The method of claim 8 further comprising a carabineer attached to the gripping element or to the storage and dispensing bag, facilitating clipping the shopping bag dispenser to an article of clothing or to a shopping cart or carriage.

10. The method of claim 6 wherein the closure is a zipper.

* * * * *